US007753564B2

(12) United States Patent
Cheng et al.

(10) Patent No.: US 7,753,564 B2
(45) Date of Patent: Jul. 13, 2010

(54) LAMPSHADE AND ILLUMINATION LAMP HAVING THE SAME

(75) Inventors: Yi-Kai Cheng, Miao-Li Hsien (TW); Jyh-Long Chern, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 42 days.

(21) Appl. No.: 12/019,908

(22) Filed: Jan. 25, 2008

(65) Prior Publication Data

US 2009/0109686 A1 Apr. 30, 2009

(30) Foreign Application Priority Data

Oct. 31, 2007 (CN) ..... 2007 1 0202344

(51) Int. Cl.
*F21V 3/00* (2006.01)

(52) U.S. Cl. ..... 362/311.06; 362/311.09; 362/311.1; 362/311.02; 362/311.01; 362/333; 362/326; 362/331; 362/336

(58) Field of Classification Search ..... 362/326–340, 362/311.01–311.15, 617–620, 217.02, 223, 362/235, 308–309; 359/625–626
See application file for complete search history.

(56) References Cited

U.S. PATENT DOCUMENTS 3,163,367 A * 12/1964 Bodian ..... 362/330
3,735,124 A * 5/1973 Stahlhut ..... 362/333
6,213,625 B1 * 4/2001 Leadford et al. ..... 362/331
6,648,496 B1 11/2003 Elghoroury et al.
6,793,361 B2 * 9/2004 Matsui ..... 362/97.1
7,121,693 B2 * 10/2006 Klose ..... 362/331
2006/0050514 A1 3/2006 Opolka (Continued)

FOREIGN PATENT DOCUMENTS

DE 19826905 A1 1/1999

(Continued)

OTHER PUBLICATIONS

Michael S. Shur et al., Solid-State Lighting: Toward Superior Illumination, Proceedings of the IEEE, vol. 93, No. 10, Oct. 2005.

*Primary Examiner*—Jong-Suk (James) Lee
*Assistant Examiner*—Robert J May
(74) *Attorney, Agent, or Firm*—Jeffrey T. Knapp

(57) ABSTRACT

An illumination lamp (40) includes at least one solid-state lighting member (41) for radiating light, and a lampshade (10) being arranged corresponding to the at least one solid-state lighting member. The lampshade includes an array of lenses (11). Each lens has an incidence surface (110) for incidence of the light into the lampshade, and an opposite emitting surface (112) for emission of the light from the lampshade into ambient. At least one of the incidence surface and the emitting surface is a concave surface. The concave surface extends along a first direction. At least one micro-structure (111) is formed on the concave surface. The at least one micro-structure is long and narrow, and extends along the first direction. The micro-structure is configured for increasing radiating area of the light entering into the lampshade along a second direction intersecting the first direction.

15 Claims, 14 Drawing Sheets

U.S. PATENT DOCUMENTS

| | | | | |
|---|---|---|---|---|
| 2006/0186425 | A1 | 8/2006 | Yano | |
| 2008/0089069 | A1* | 4/2008 | Medendorp | 362/294 |

FOREIGN PATENT DOCUMENTS

| | | | |
|---|---|---|---|
| EP | 0678702 | A1 | 10/1995 |
| EP | 1621918 | A1 | 2/2006 |
| JP | 05-0281402 | A | 10/1993 |
| TW | 200504307 | A | 2/2005 |
| TW | 1243944 | | 11/2005 |
| WO | WO 99/36896 | A1 | 7/1999 |

* cited by examiner

LAMPSHADE AND ILLUMINATION LAMP HAVING THE SAME

BACKGROUND OF THE INVENTION

1. Field of the Invention

The present invention generally relates to an illumination lamp, and particularly to a lampshade of the illumination lamp.

2. Description of Related Art

In recent years, light emitting diode (LED) as a highly efficient light source is widely used in such fields as automobiles, display screens, and traffic lights.

FIG. 14 shows a simulated view of a light field of the LED. The light field of the LED is approximately circular. An intensity of the light field of the LED gradually decreases outwardly along a radial direction. Thus, the light field intensity near the LED is higher, and the light field intensity far from the LED is lower. However, in some cases, when the LED is adopted for a street lamp, as the street being long and narrow, the shape of the circular-shaped light field is different from that of the street. As a result of that, a lighting area of such LED projected on the street is small. Thus, more LEDs are required for lighting the street, resulting in high cost and inefficient of energy. For the foregoing reasons, there is a need in the art for an illumination lamp which overcomes the above-described shortcomings.

SUMMARY OF THE INVENTION

In accordance with the present embodiment, an illumination lamp includes at least one solid-state lighting member for radiating light, and a lampshade being arranged corresponding to the at least one solid-state lighting member. The lampshade includes an array of lenses. Each lens has an incidence surface for receiving of the light emitted from the at least one solid-state lighting member, and an opposite emitting surface for emitting light from the lampshade into ambient. At least one of the incidence surface and the emitting surface is a concave surface. The concave surface is elongated along a first direction. At least one micro-structure is formed on the concave surface. The at least one micro-structure is long and narrow, and extends along the first direction. The micro-structure is configured for increasing radiating area of the light entering into the lampshade along a second direction intersecting the first direction.

Other advantages and novel features of the present invention will be drawn from the following detailed description of a preferred embodiment of the present invention with attached drawings, in which:

BRIEF DESCRIPTION OF THE DRAWINGS

The present invention is described in greater detail hereinafter, by way of example only, through description of a preferred embodiment thereof and with reference to the accompanying drawing in which.

DETAILED DESCRIPTION OF THE INVENTION

Figure 1:
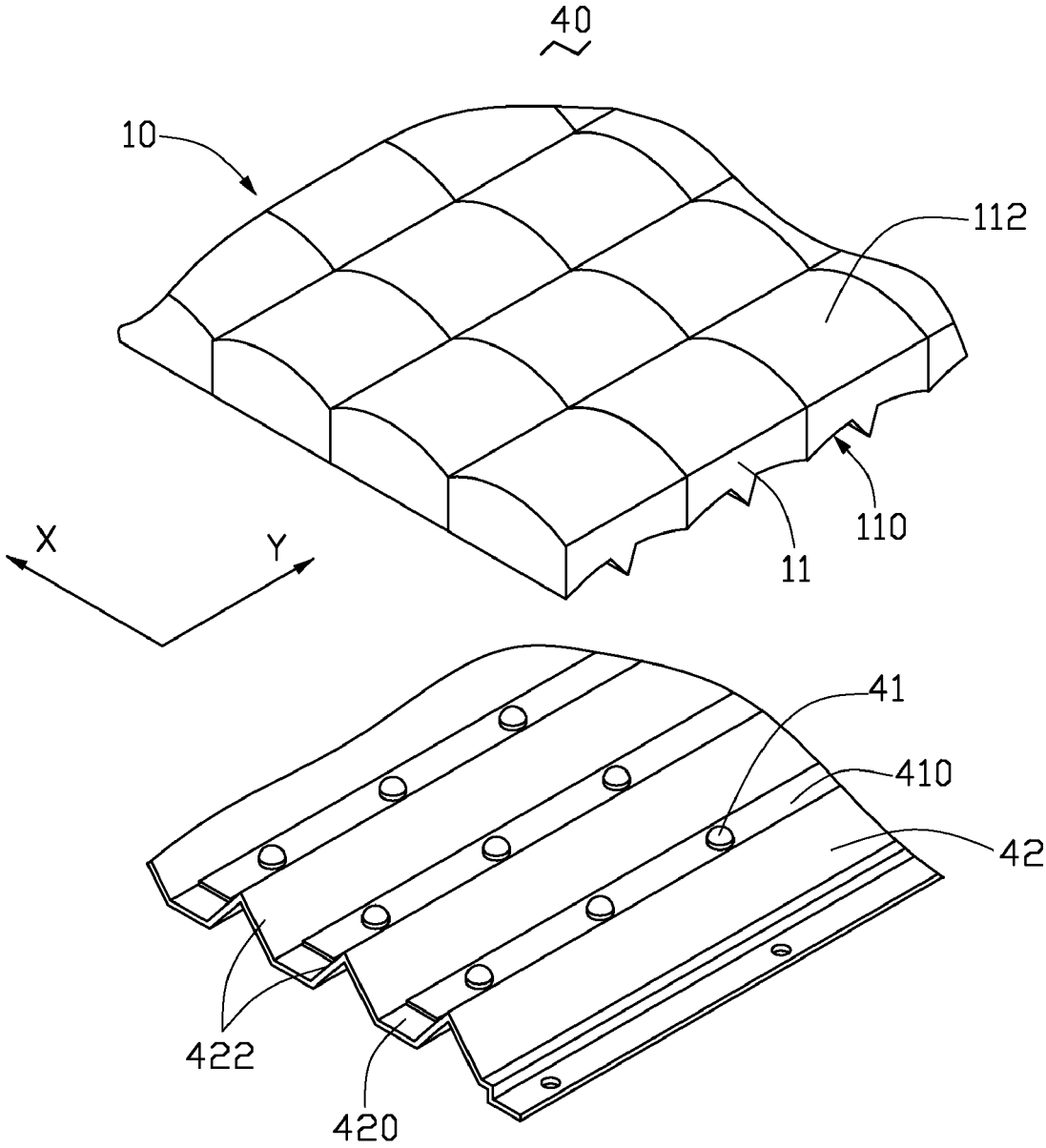
FIG. 1 is an explored, abridged general view of an illumination lamp in accordance with a first embodiment of the present invention.

The detailed description of an imaging device according to the present invention will now be made with reference to the attached drawings. Referring to FIG. 1, the illumination lamp 40 includes a plurality of solid-state lighting members 41, a plurality of circuit boards 410, a reflecting board 42 and a lampshade 10.

The reflecting board 42 is wave-shaped. A cross section of the reflecting board 42 along the X-direction is wave-shaped, which includes a plurality of horizontal flat sections 420 and a plurality of serrate sections 422 each interconnects with two neighboring horizontal flat sections 420. A trapezoid-shaped interspace (not labeled) is thus defined among each horizontal flat section 420 and two neighboring serrate sections 422 of the horizontal flat section 420. Each circuit board 410 is arranged on a corresponding horizontal flat section 420, and is received in a corresponding interspace. The solid-state lighting members 41 are arranged on the circuit boards 410 and are electrically connected to the circuit board 410. Thus, when electric currents are applied to the solid-state lighting members 41 through the circuit board 410, the solid-state lighting members 41 radiate light. In this embodiment, the solid-state lighting members 41 are light emitting diodes (LEDs). The LEDs 41 are arranged on the reflecting board 42 spaced evenly from each other.

Figure 2:
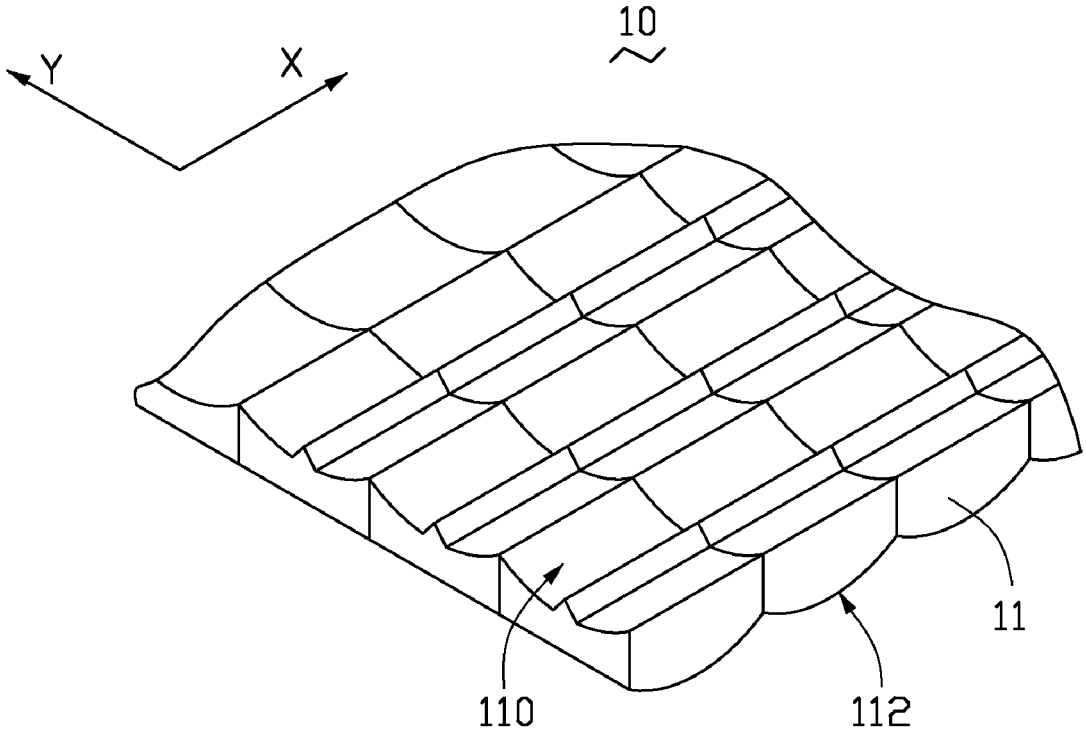
FIG. 2 is an abridged general view of a lampshade of the illumination lamp viewed from another aspect.
Figure 3:
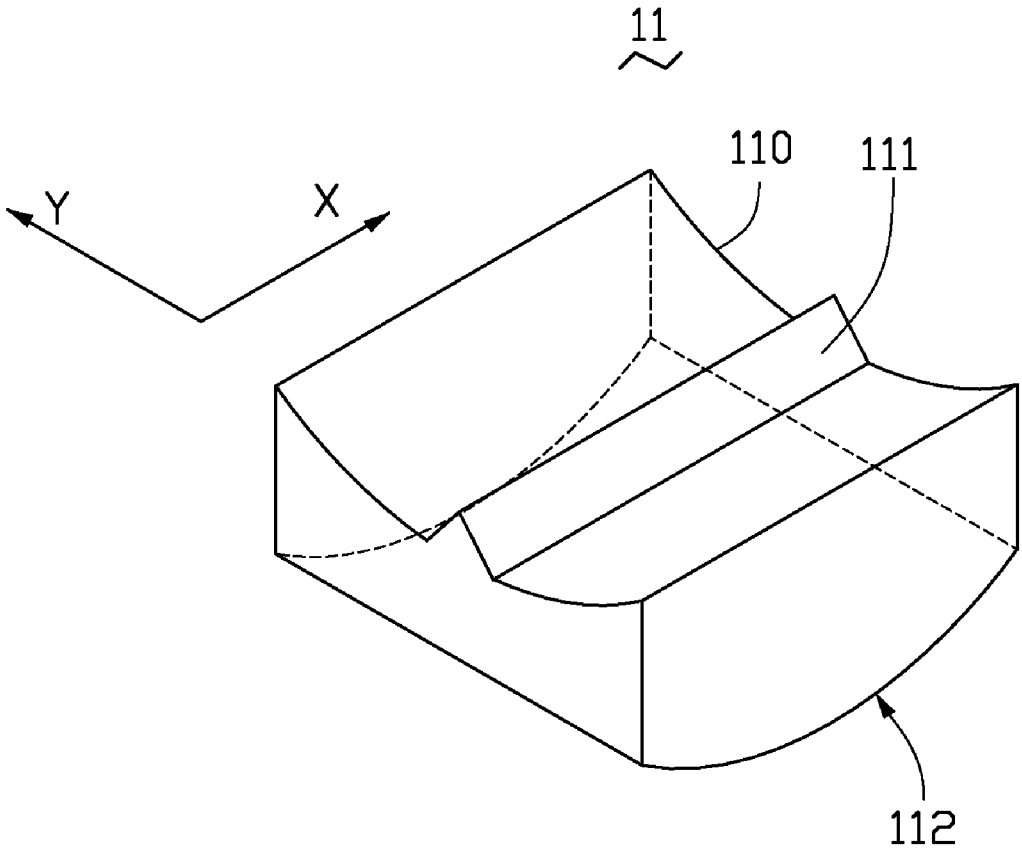
FIG. 3 is an isometric view of one lens of the lampshade of FIG. 2.
Figure 4:
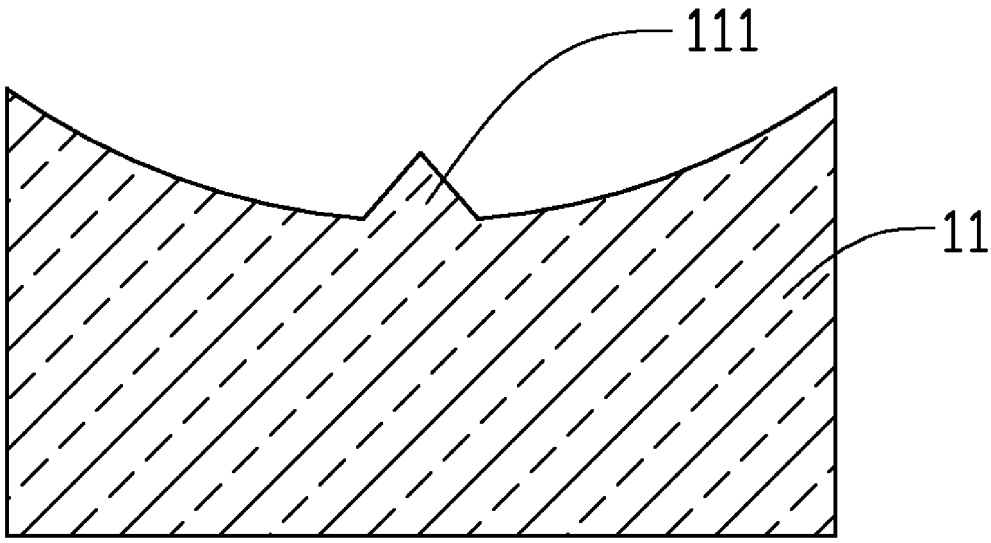
FIG. 4 is a cross-sectional view of the lens of FIG. 3.

As shown in FIGS. 2-4, the lampshade 10 is arranged over the LEDs 41. The lampshade 10 includes a plurality of lenses 11. The number of the lenses 11 is the same as that of the LEDs 41. Each LED 41 is arranged corresponding to one lens 11. In this embodiment, the lenses 11 are formed separately and then assembled together. Alternatively, the lenses 11 can be integrally formed. Each lens 11 includes an incidence surface 110 facing to the corresponding LED 41, and an emitting surface 112 opposite to the incidence surface 110. The incidence surface 110 is a concave surface being configured for receiving the light of the LED 41, whilst the emitting surface 112 is a convex surface being configured for emitting light from the lampshade 10 into ambient. The concave surface 110 and the convex surface 112 are column-shaped, and extend along the Y-direction. In this embodiment, the Y-direction is perpendicular to the X-direction. Each lens 11 forms a micro-structure 111 thereon. The micro-structure 111 is a long and narrow protrusion, and extends outwardly from the lens 11 along the X-direction. A cross section of micro-structure 111 along the Y-direction is triangle.

Figure 5:
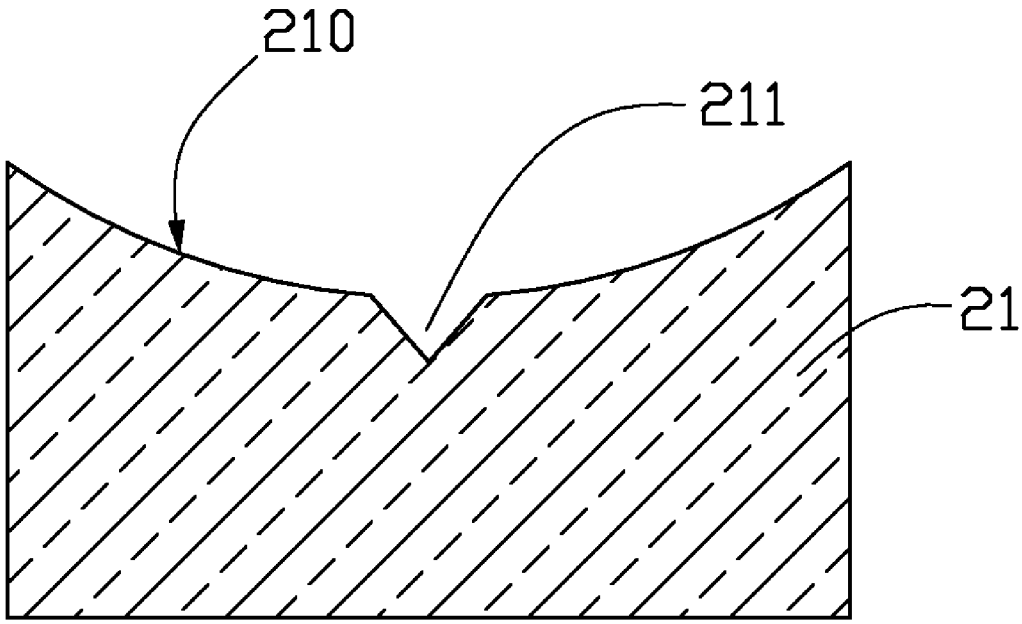
FIG. 5 is similar to FIG. 4, but shows a second embodiment of the lens.
Figure 6:
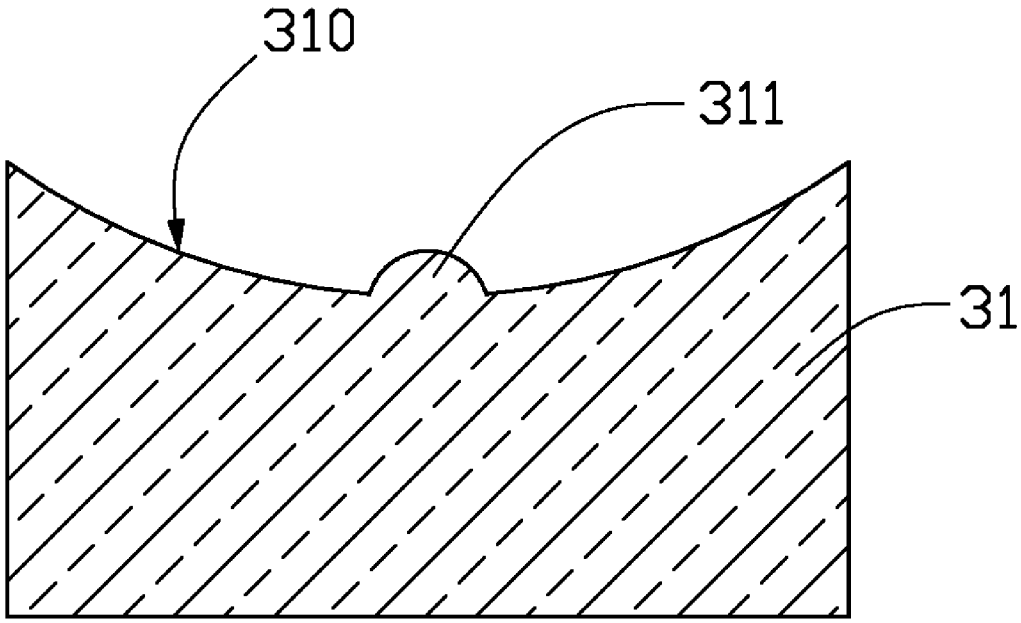
FIG. 6 is a cross-sectional view of the lens in accordance of a third embodiment.
Figure 7:
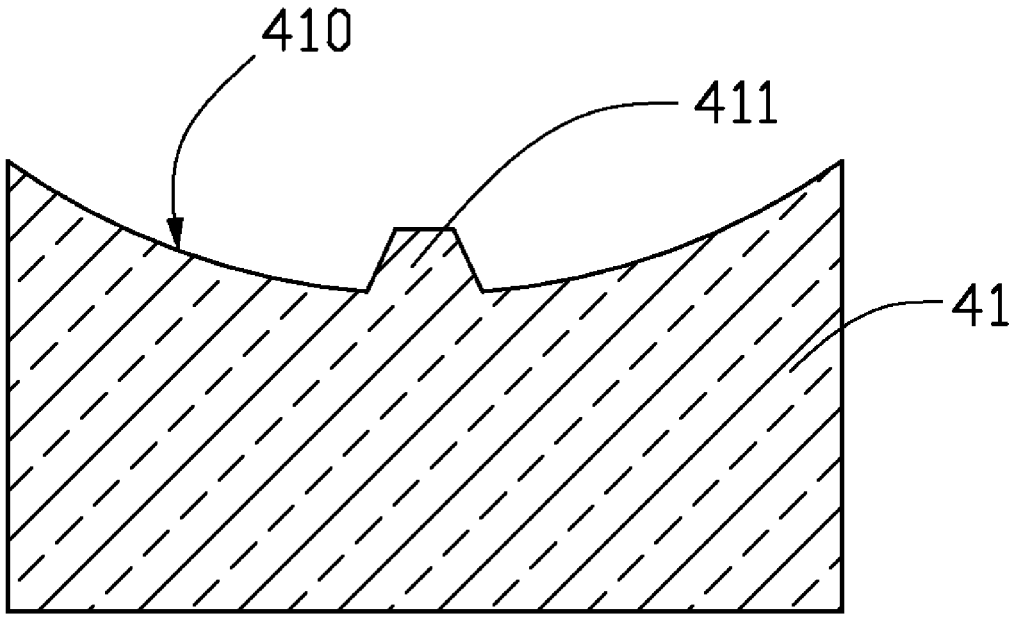
FIG. 7 shows a cross-sectional view of the lens of a fourth embodiment.
Figure 8:
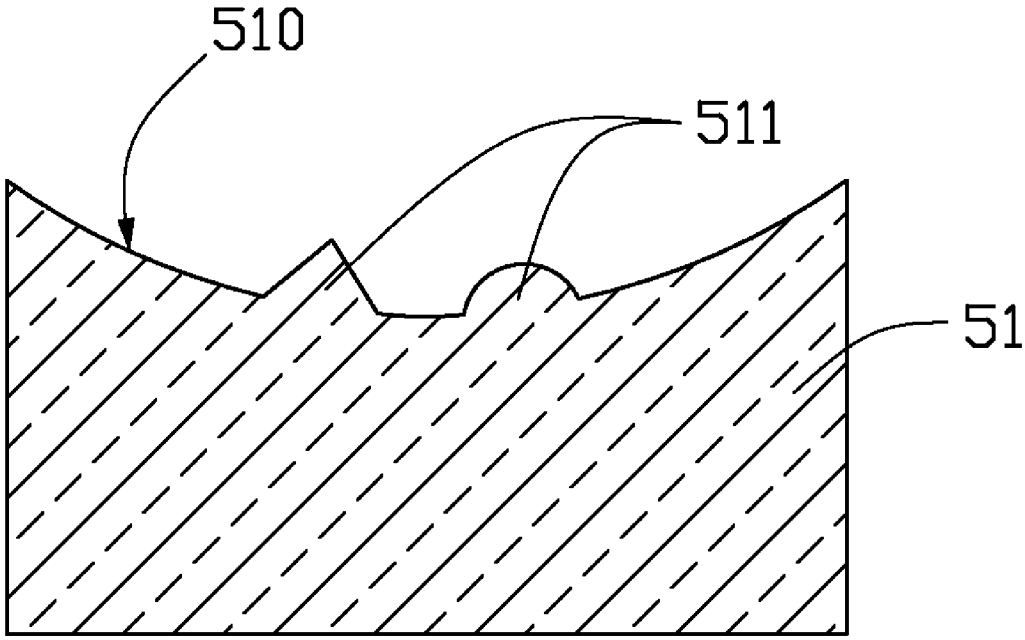
FIG. 8 shows the lens according to a fifth embodiment.

FIGS. 5-8 show different types of the micro-structures 211, 311, 411, 511 formed on the concave surfaces 210, 310, 410, 510 of the lenses 21, 31, 41, 51. As shown in FIG. 5, the lens 21 includes a concave incidence surface 210 with a micro-structure 211 formed thereon. The difference between this embodiment and the first embodiment is that the micro-structure 211 formed on the concave surface 210 is a long and narrow groove extending inwardly from the concave surface 210. The cross section of micro-structure 211 along the Y-direction is triangle. In FIG. 6, the micro-structure 311 has a hemisphere—shaped cross section along the Y-direction, and in FIG. 7 the micro-structure 411 has a trapezoid-shaped cross section along the Y-direction. As shown in FIG. 8, the lens 51 forms two micro-structures 511 on the concave surface 510. The two micro-structures 511 are spaced from each other. One of the micro-structures 511 has a triangle-shaped cross section, and the other micro-structure 511 has a trapezoid-shaped cross section. It is to be understood that the micro-structures 111, 211, 311, 411, 511 formed on the lens 11, 21, 31, 41, 51 can be more than two, such as three, five and so on. And the micro-structures 111, 211, 311, 411, 511 can have shapes the same as or being different from each other.

Figure 9:
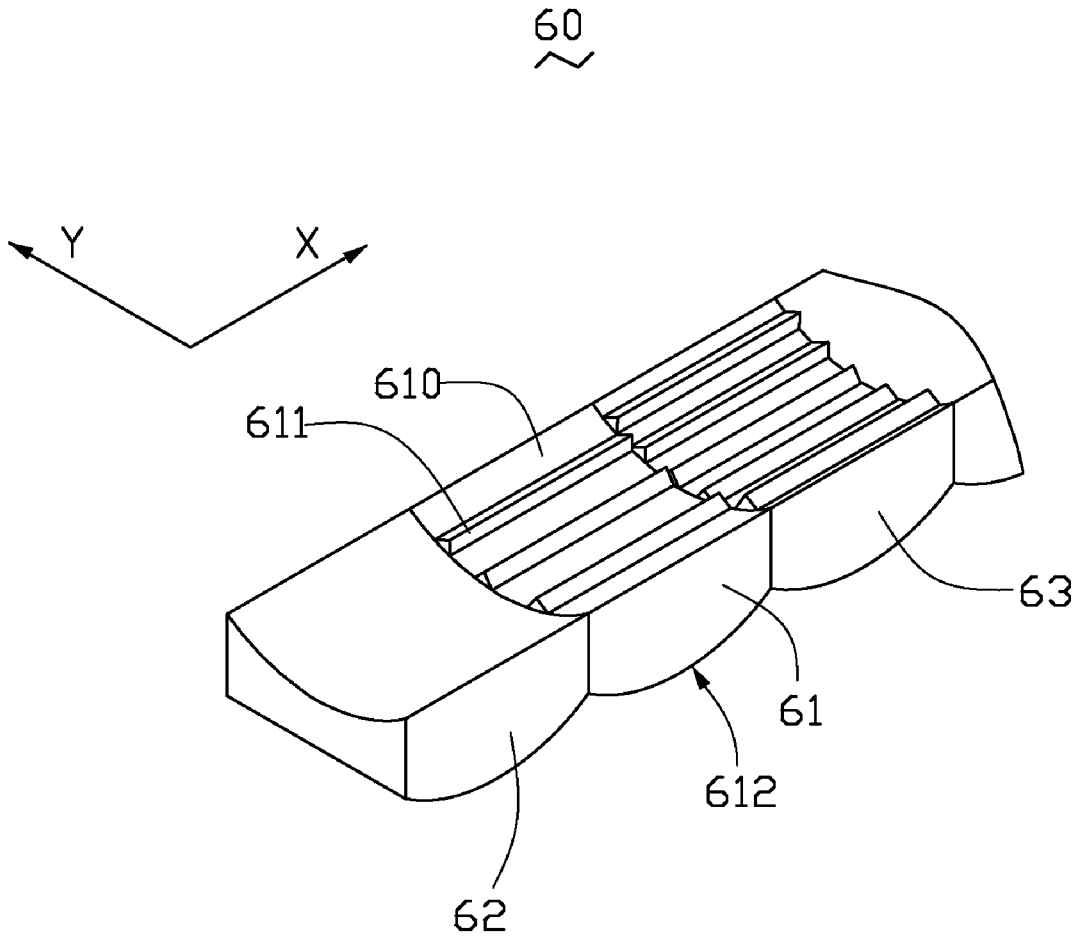
FIG. 9 is similar to FIG. 2, but shows an alternative embodiment of the lampshade.
Figure 10:
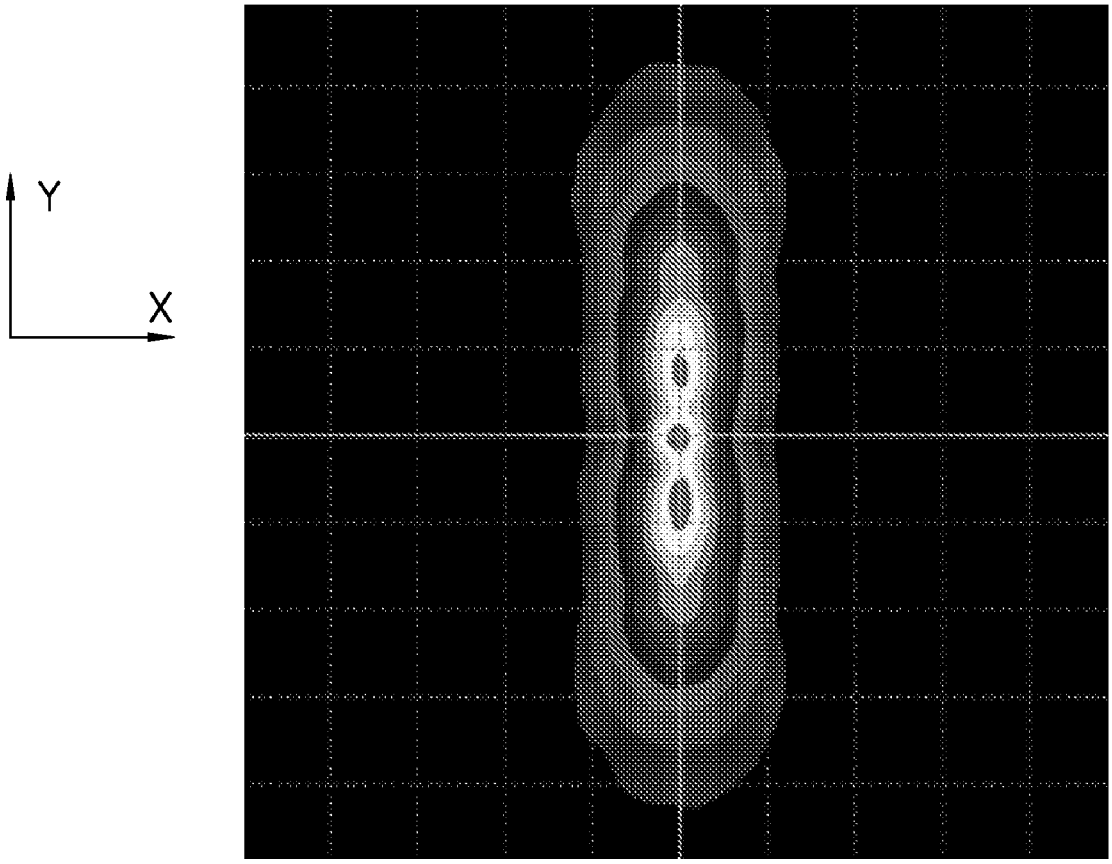
FIG. 10 shows a simulated view of a light field of the illumination lamp incorporating the lampshade of FIG. 9.
Figure 11:
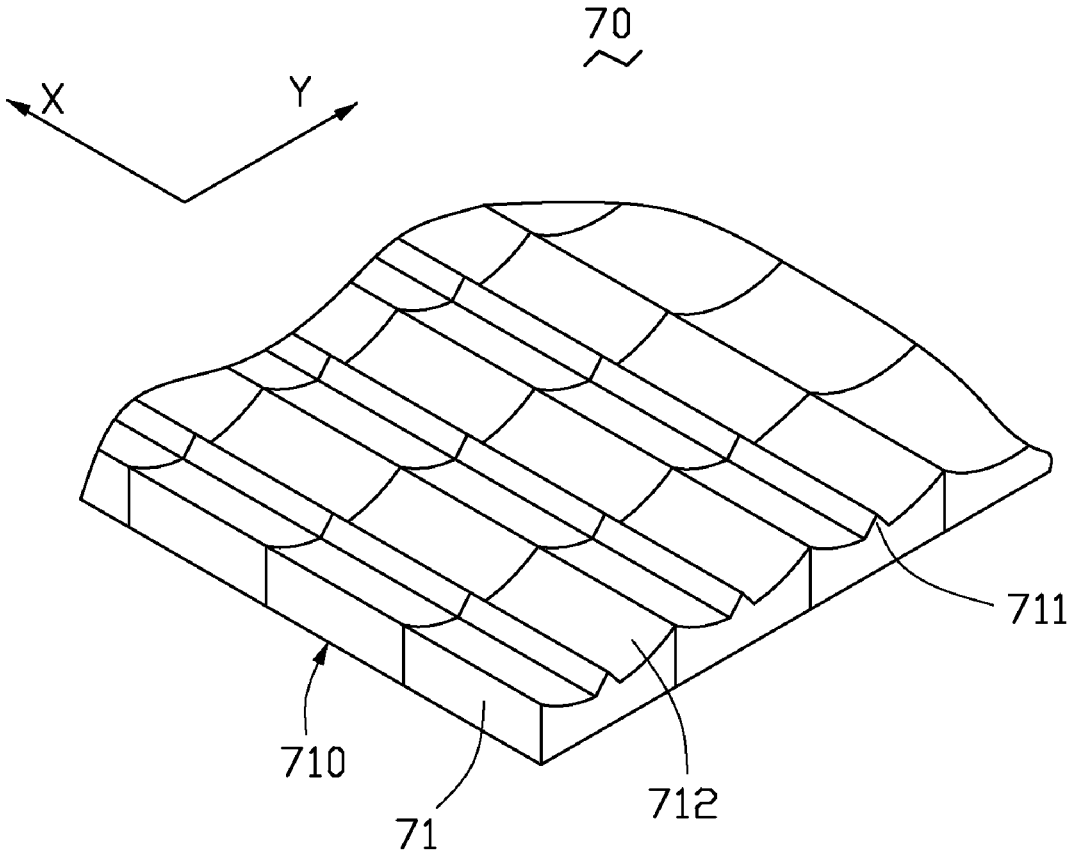
FIG. 11 shows a third embodiment of the lampshade.

During operation, when the electric currents are applied to the LEDs 41, the LEDs 41 radiates light. The reflecting board 42 reflects part of the light to the lampshade 10. Thus, approximately all of the light generated by the LEDs 41 enters into the lampshade 10 through the incidence surface 110, 210, 310, 410, 510. The micro-structures 111, 211, 311, 411, 511 can increase radiating area of the light along the Y-direction when the light enters into the lampshade 10 through an outer surface of the micro-structure 111, 211, 311, 411, 511. Conversely, the convex surface 112 is used for contracting radiating area of the light along the X-direction. Thus, the area along the Y-direction is increased, and the area along the X-direction is decreased. The circular-shaped light field of the LEDs 41 is thus elongated. It is to be understood that the micro-structures 111 are configured for increasing radiating area of the LEDs 41, and the number, the arrangement of the micro-structures 111 can be changed according to the shape or the size of the illumination lamp. FIGS. 9-10 show a concrete illumination lamp and its light field adopting the lampshade 60 having micro-structures 611. As shown in FIG. 10, the lampshade 60 has three lenses 61. The middle lens 61 forms three micro-structures 611 thereon, and the right lens 63 forms five micro-structures 611 thereon. The left lens 62 faces six of the LEDs 41, the middle lens 61 faces three of the LEDs 41, and the right lens 63 faces eight of the LEDs 41. FIG. 11 shows the simulated view of the light field of the illumination lamp 40 of FIG. 10, which is elongated. The shape of the light field is approximately the same as that of the street, thus all of the light radiating by the LEDs 41 can be utilized.

Figure 12:
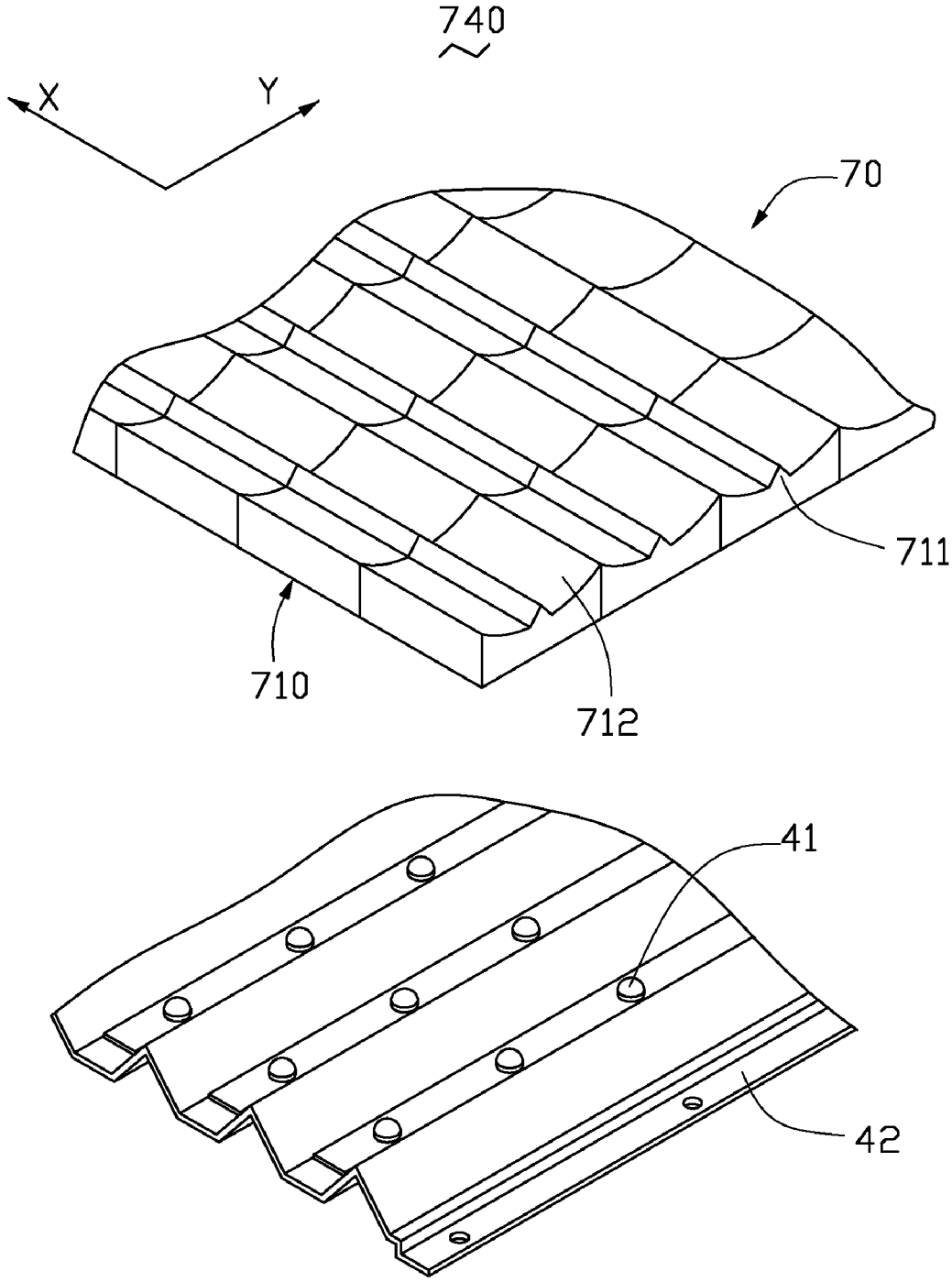
FIG. 12 shows an explored view of the illumination lamp incorporating the lampshade of FIG. 11.
Figure 13:
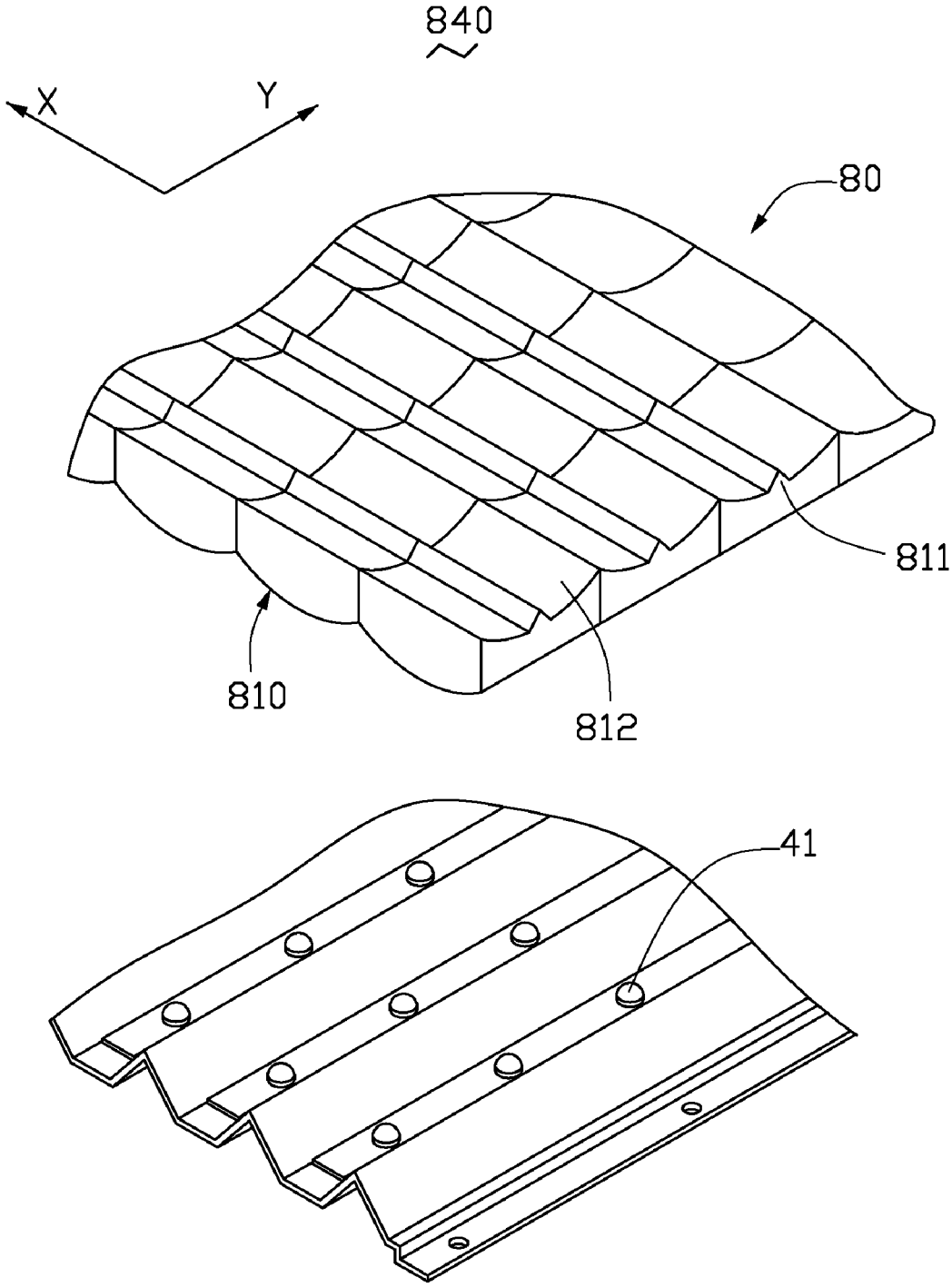
FIG. 13 shows an explored view of the illumination lamp incorporating a lampshade of a fourth embodiment.
Figure 14:
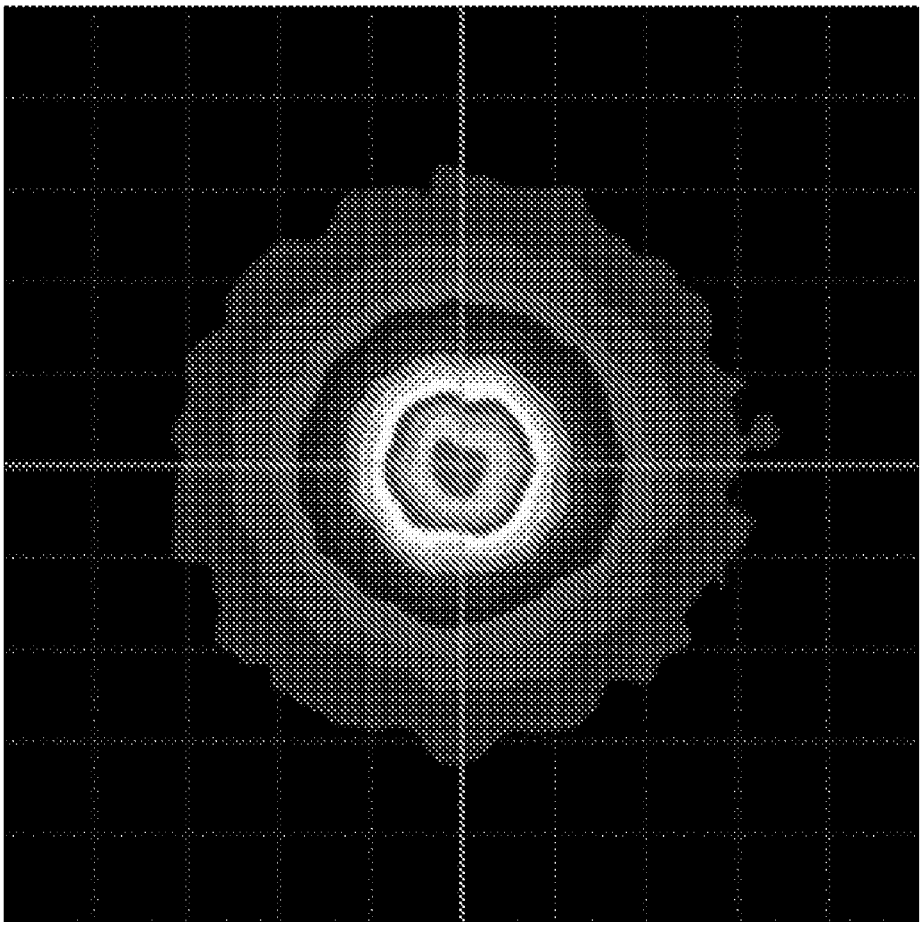
FIG. 14 (RELATED ART)
FIG. 14 shows a simulated view of the light field of a related illumination lamp.

Referring to FIGS. 11-12, the illumination lamp 740 according to a third embodiment of the present invention is shown. Also the illumination lamp 740 includes a plurality of LEDs 41 arranged on a reflecting board 42, and a lampshade 70 arranged over the LEDs 41. The lampshade 70 is constructed by a plurality of lenses 71. Each lens 71 forms an incidence surface 710 facing the LEDs 41, and an emitting surface 712 opposite to the incidence surface 710. The difference between this embodiment and the first embodiment is that the incidence surface 710 is a planar surface, and the emitting surface 712 is a concave surface 710. The micro-structure 711 is formed on the concave emitting surface 712. FIG. 13 shows a fourth embodiment of the illumination lamp 840 of the present invention. The different between this embodiment and the first embodiment is that the incidence surface 810 is a convex surface, and the emitting surface 812 is a concave surface. The micro-structure 811 is formed on the concave emitting surface 812.

It can be understood that the above-described embodiment are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. An illumination lamp comprising:

at least one solid-state lighting member for generating light; and a lampshade arranged corresponding to the at least one solid-state lighting member, the lampshade having an array of lenses, each lens comprising an incidence surface for receiving the light emitted from the at least one solid-state lighting member, and an opposite emitting surface for emission of the light to the ambient environment, one of the incidence surface and the emitting surface being a concave surface elongated along a first direction, the other of the incidence surface and the emitting surface being a convex surface elongated along a second direction intersecting the first direction, at least one elongated micro-structure being formed on the concave surface, the at least one elongated micro-structure extending along the first direction, the micro-structure being configured for increasing a radiating area of the light entering the lampshade along the second direction, the convex surface being configured for contracting the radiating area of the light along the first direction.

2. The illumination lamp of claim 1, wherein the micro-structure is a protrusion extending outwardly from the concave surface.

3. The illumination lamp of claim 1, wherein the micro-structure is a groove defined in the concave surface.

4. The illumination lamp of claim 1, wherein a cross section of the micro-structure taken along a direction perpendicular to the first direction is in one of the following shapes: a triangle, a hemicycle, and a trapezoid.

5. The illumination lamp of claim 1, wherein the first direction and the second direction are perpendicular to each other.

6. The illumination lamp of claim 1, further comprising a reflecting board, the reflecting board being wave-shaped, comprising a plurality of horizontal flat sections and a plurality of serrate sections each interconnecting two neighboring horizontal flat sections, the at least one solid-state lighting member being arranged on the horizontal flat sections.

7. The illumination lamp of claim 1, wherein the at least one solid-state lighting member is at least one light emitting diode.

8. The illumination lamp of claim 1, wherein the at least one solid-state lighting member comprises an array of light emitting diodes, each light emitting diode being arranged spatially corresponding to one lens.

9. A lampshade comprising an array of lenses, each lens comprising an incidence surface for receiving light from a light source, and an opposite emitting surface for emission of the light into the ambient environment, one of the incidence surface and the emitting surface being a concave surface elongated along a first direction, the other of the incidence surface and the emitting surface being a convex surface elongated along a second direction intersecting the first direction, at least one elongated micro-structure being formed on the concave surface, and extending along the first direction, the micro-structure being configured for increasing a radiating area of the light entering the lampshade along the second direction, the convex surface being configured for contracting the radiating area of the light along the first direction.

10. The lampshade of claim 9, wherein the micro-structure is a protrusion extending outwardly from the concave surface.

11. The lampshade of claim 9, wherein the micro-structure is a groove defined in the concave surface.

12. The lampshade of claim 9, wherein a cross section of the micro-structure taken along a direction perpendicular to the first direction is in one of the following shapes: a triangle, a hemicycle, and a trapezoid.

13. The lampshade of claim 9, wherein the first direction and the second direction are perpendicular to each other.

14. An illumination lamp, comprising:

at least one solid-state lighting member for generating light;

and a lampshade being arranged corresponding to the at least one solid-state lighting member, the lampshade comprising an array of lenses, each lens being configured for contracting a radiating area of the light along a first direction and increasing the radiating area of the light along a second direction intersecting the first direction in order to generate a long and narrow light field;

wherein each lens comprises an incidence surface for receiving the light generated by the at least one solid-state lighting member, and an opposite emitting surface for emission of the light from the lampshade into the ambient environment, one of the incidence surface and the emitting surface being a concave surface elongated along the first direction, the other of the incidence surface and the emitting surface being a convex surface elongated along the second direction, at least one micro-structure being formed on the concave surface, the at least one micro-structure being long and narrow, and extending along the first direction, the at least one micro-structure being configured for increasing a radiating area of the light entering into the lampshade along the second direction the convex surface being configured for contracting the radiating area of the light along the first direction.

15. The illumination lamp of claim 14, wherein the at least one micro-structure is a protrusion extending outwardly from the concave surface or a groove defined in the concave surface, a cross section of the at least one micro structure taken along a direction perpendicular to the first direction being in one of the following shapes: a triangle, a hemicycle, and a trapezoid.

* * * * *